US005894849A

United States Patent [19]

Ehlhardt et al.

[11] Patent Number: 5,894,849

[45] Date of Patent: Apr. 20, 1999

[54] INSTRUMENT FOR STYLING HAIR

[75] Inventors: Huub Ehlhardt, Groningen; Lippe Van Den Brug, Drachten; Jacobus K. Westra, Groningen, all of Netherlands

[73] Assignee: U.S. Philips Corporation, New York, N.Y.

[21] Appl. No.: 08/988,595

[22] Filed: Dec. 11, 1997

[30] Foreign Application Priority Data

Apr. 29, 1997 [EP] European Pat. Off. ..... 96203697

[51] Int. Cl.[6] ..... A45D 20/08

[52] U.S. Cl. ..... 132/271; 132/129; 34/97

[58] Field of Search ..... 132/271, 112, 132/272, 211, 107, 118, 119.1, 129; 15/246.2, 344, 402, 405; 34/96, 97, 98, 101

[56] References Cited

U.S. PATENT DOCUMENTS

| | | | |
|---|---|---|---|
| 3,981,313 | 9/1976 | Burke et al. | 34/97 |
| 5,235,759 | 8/1993 | Rizzuto, Jr. | 34/97 |
| 5,488,783 | 2/1996 | Parkinson et al. | 34/98 |
| 5,546,674 | 8/1996 | Lange et al. | 34/97 |
| 5,638,608 | 6/1997 | Dorber | 132/118 |
| 5,671,547 | 9/1997 | Truchet et al. | 34/96 |
| 5,715,847 | 2/1998 | Rolf et al. | 132/271 |

FOREIGN PATENT DOCUMENTS

| | | | |
|---|---|---|---|
| 94/09669 | 5/1994 | WIPO | A45D 20/12 |

*Primary Examiner*—Gene Mancene
*Assistant Examiner*—Pedro Philogene
*Attorney, Agent, or Firm*—Ernestine C. Bartlett

[57] ABSTRACT

An instrument for styling hair comprises a movable carrier, elongate hair guides which project from the carrier, and a passage for allowing hot air to pass through. The passage and the carrier being adapted to influence the discharge direction in dependence upon the position of the carrier in such a manner that a pivotal movement in a first direction of the carrier with the hair guides which project therefrom results in a change of the discharge direction through the passage in a substantially opposite second direction. During use this prevents hairs just released by the hair guides passing through the hair from being muddled up again. The hair-style is better under control and less combing and brushing is necessary.

14 Claims, 3 Drawing Sheets

INSTRUMENT FOR STYLING HAIR

BACKGROUND OF THE INVENTION

The invention relates to an instrument for styling hair.

Such an instrument is known from WO-A-94/09669, which corresponds substantially to U.S. Pat. No. 5,546,674, the instrument comprising: at least one carrier which is movably supported by the housing, elongate hair guides which project from the carrier, and at least one passage for discharging hot air in a discharge direction away from the housing. The passage and the carrier are adapted to influence the discharge direction in dependence on the position of the carrier relative to the housing.

According to said German Patent Application the hair can be styled and dried more effectively by influencing the discharge direction and it is possible, in particular, to dry the parts of the hair which are situated near the scalp, as a result of which the hair has more body. The stream of hot air is then led past the head, which precludes an unpleasantly strong heating of the scalp according to said Patent Application. As the hair guides are moved through the hair the hair guides are subjected to a force which causes them to be pivoted in a direction opposed to that in which the hair guides are moved through the hair. The discharge direction of the air then changes into the same direction as that in which the hair guides pivot, as a result of which the discharge direction during combing and/or brushing is each time opposed to the direction of brushing and/or combing.

SUMMARY OF THE INVENTION

It is an object of the invention to provide an instrument by means of which the hair can be styled more rapidly and better.

According to the present invention this object is achieved in that the carrier is adapted to influence the passage in such a manner that a movement of the hair guides which project from the carrier in a first direction with respect to the housing results in a change of the discharge direction through said passage in a second direction substantially opposite to said first direction.

When an instrument in accordance with the invention is used, this prevents hairs just released by the hair guides passing through the hair from being muddled up again. As a result, the hair-style during combing and/or brushing is better under control and less combing and brushing is necessary, which saves time and affects the resilience of the hair to a smaller extent.

Since the imbricate structure of the hair is not disturbed by the outgoing air stream but is rather enhanced when an instrument in accordance with the invention is used, the hair will generally be more glossy after styling by means of an instrument in accordance with the invention than after styling by means of known instruments.

In special embodiments of the invention, an instrument as described above will further comprise at least one air guiding surface (17), which is movable along with the carrier (10, 11), for changing the direction of the air (7, 7') passing through the passage (15), in which the air guiding surface (17) and the carrier (10, 11) are constructed in such a manner that the effective discharge area of the passage (15) in a position of the carrier (10, 11) for deflecting the outflowing air (7') is at least equal to the effective discharge area of the passage (15) in a position of the carrier (10, 11) for the substantially straight passage of the outflowing air (7).

Further, an instrument is provided in which:

- the air guiding surface (17) and the carrier (10, 11) are constructed in such a manner that the effective discharge area of the passage (15) in a position of the carrier (10, 11) for deflecting the outflowing air (7') is greater than the effective discharge area of the passage (15) in a position of the carrier (10, 11) for the substantially straight passage of the outflowing air (7).
- in which the air guiding surface (17) is carried by the carrier (10, 11);
- in which the air guiding surface (17) is disposed between passages (15) at opposite sides of said air guiding surface (17) and is pivotable between a position oriented substantially transversely to the discharge direction and a position oriented more parallel to the discharge direction;
- in which the air guiding surface (17) is curved at least in the plane in which it is pivotable;
- in which the carrier (10, 11) has a biconvex shape in a cross-section perpendicular to its pivotal axis;
- comprising at least two of said carriers (10, 11);
- further comprising coupling means (18) which couple the carriers (10, 11) to one another so as to cause the carriers (10, 11) to be pivoted jointly;
- in which the carrier (10, 11) is supported so as to be pivotable about a pivotal axis with respect to the housing (9) and the hair guides (12, 13, 14) which project from the carrier (10, 11) are arranged in double rows of V-shaped cross-section, which are oriented parallel to said pivotal axis;
- in which the hair guides (12, 13, 14) include coarse hair guides (12) which form a comb and fine hair guides (13, 14) which form a brush;
- in which the housing (9) has a coupling portion (20) which is remote from the hair guides (12, 13, 14), for coupling to a hair dryer unit (1);
- further comprising a hair dryer unit (1) having an air inlet (5), a fan (2) and a heating element (3) for heating air (7, 7') which passes through; and
- in which the housing also accommodates an air inlet, a fan and a heating element for heating air which passes through.

The instrument can be constructed, for example, as an attachment to be fitted onto a hair-dryer unit, as a one-piece hair dryer or hot-air brush, or as a combination of a hair-dryer unit with an attachment coupled thereto.

BRIEF DESCRIPTION OF THE DRAWINGS

The invention will be described in more detail hereinafter with reference to embodiments given by way of examples, with reference to the drawings. In the drawings.

DESCRIPTION OF THE PREFERRED EMBODIMENTS

Figure 1:
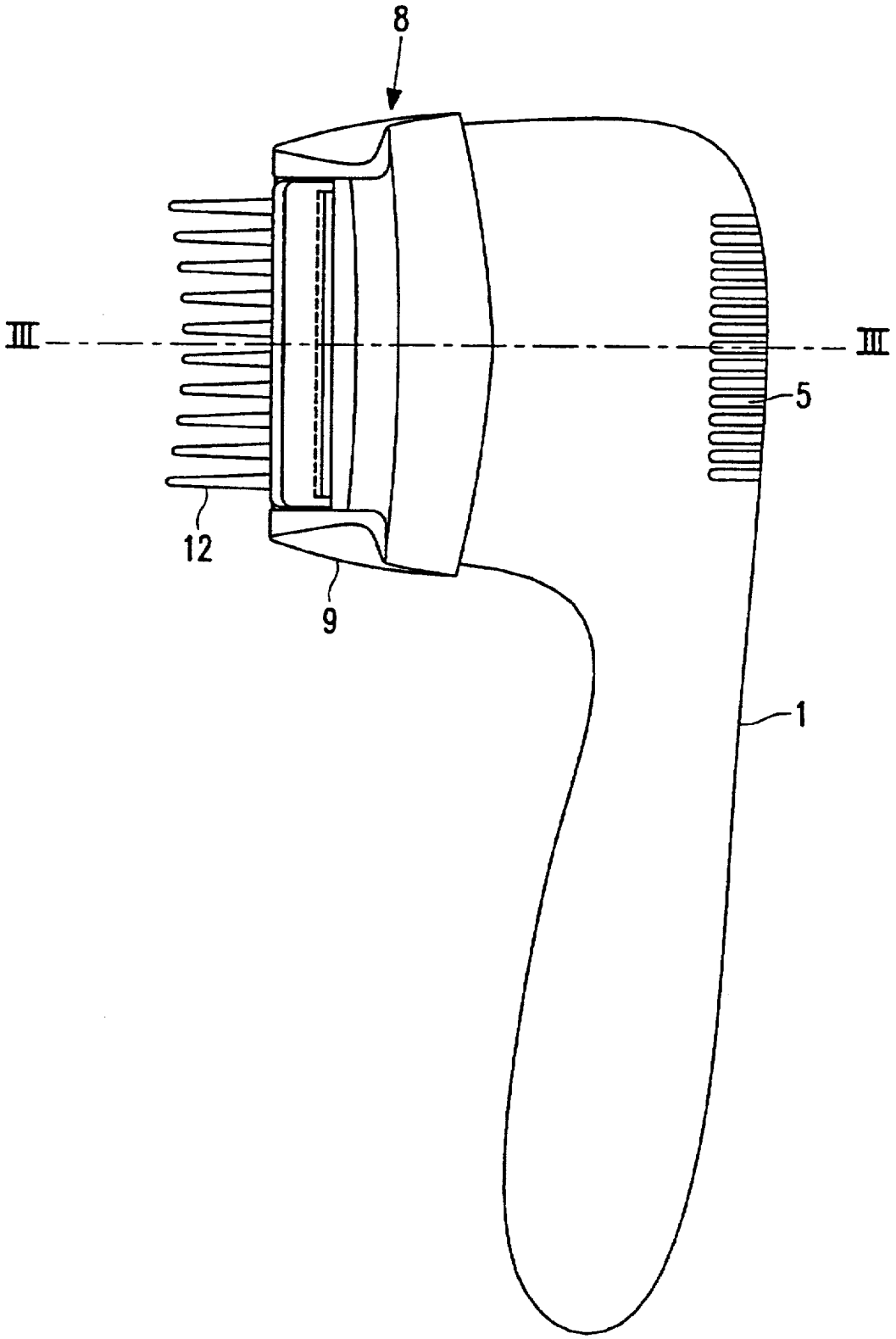
FIG. 1 is a side view showing a hair dryer equipped with an instrument in accordance with an embodiment of the invention.
Figure 2:
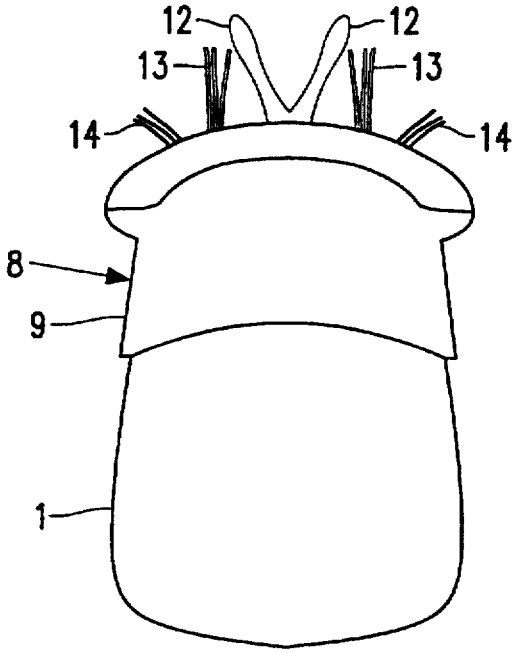
FIG. 2 is a side view of the same hair dryer, taken perpendicularly to the side view of FIG. 1.
Figure 3:
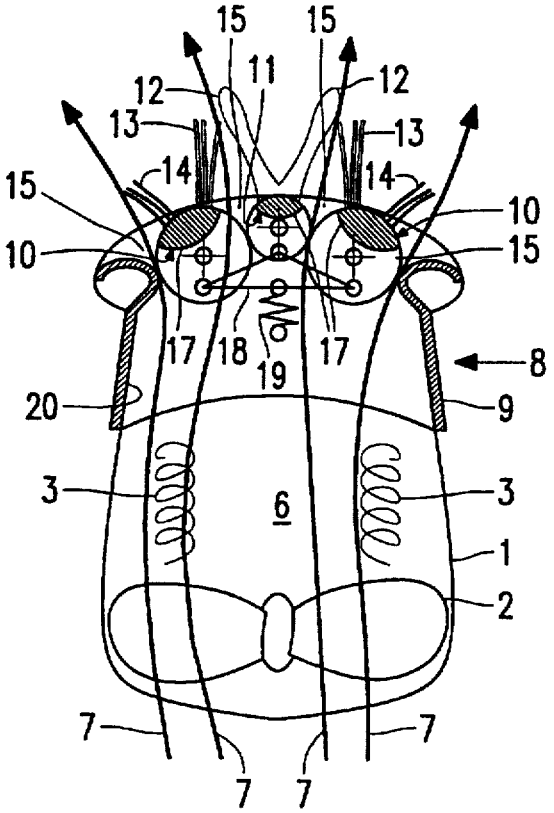
FIG. 3 is a diagrammatic sectional view taken on the line III—III in FIG. 1.

The instrument will first be described in accordance with the most preferred embodiment as shown FIGS. 1–4.

Subsequently, attention will be paid to alternative embodiments as shown, for example, in FIG. 5. In the drawings like parts bear identical reference numerals.

FIGS. 1–4 show a device for styling the hair while its is being dried, which device is referred to hereinafter as a hair dryer for the sake of simplicity. The hair dryer comprises a hair dryer unit 1, which accommodates a fan 2 and heating elements 3. The fan 2 and the heating elements 3 are disposed in an air channel 6 which extends from air inlets 5 through the hair dryer unit 1. The air flowing through the channel 6 is represented by means of arrows 7, 7' in FIGS. 3 and 4.

An instrument for hair-styling, formed by an easy-to-exchange attachment 8, is mounted on the hair dryer unit 1. This attachment 8 comprises inter alia a housing 9, carriers 10, 11 which are pivotably supported by the housing 9, and elongate hair guides 12, 13, 14 which project from the carriers 10, 11. The hair guides 13, 14 are not shown in FIG. 1. The attachment 8 further has passages for hot air in discharge directions away from the housing 8 (which directions are indicated by parts of the arrows 7, 7" in the area of the passages 15). The hair guides 12, 13, 14 form combs and brushes for ordering and styling the hair.

Figure 4:
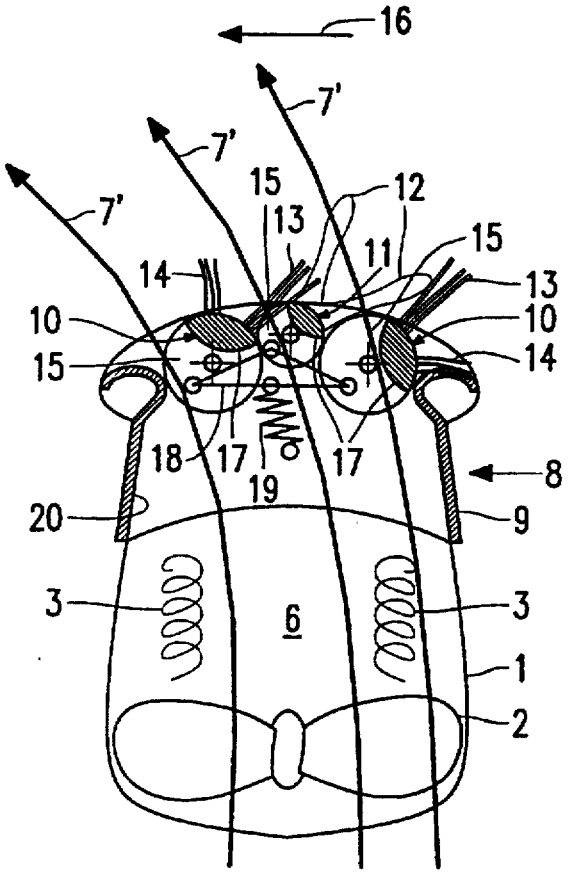
FIG. 4 is a view similar to FIG. 3 in another operating condition.

The carriers 10, 11 are adapted to influence the passages 15 in such a manner that a pivotal movement of the carriers 10, 11 with the hair guides 12, 13, 14, which project therefrom, in a first direction relative to the housing 8 results in a change or at least deflection or excursion of the air stream 7, 7' in the area of the passages in a second substantially opposite direction. If, for example as is shown in FIG. 4, the combs and brushes formed by the hair guides 12, 13, 14 and the carriers 10, 11 from which they project are pivoted to the right in that the hair dryer is moved through the hair to the left (in the direction indicated by an arrow 16), the air stream 7' issuing from the passages 15 is also directed to the left. As a result of this, it is always directed in the combing direction. The effect of this is that during combing and/or brushing of the hair the air stream is guided past the head in a more parallel direction than in the case that it simply issues frontally from the attachment 8, and that hair which has been urged into a certain position by the hair guides 12, 13, 14 is not immediately blown out of this position as soon as it is freed from the hair guides 12, 13, 14. This results in a better styling control, a more rapid styling and less loss of resilience of the hair since the hair needs to be heated, brushed and combed less frequently in order to obtain a desired hair-style. As in the case that the proposed attachment 8 is used the nearly dry hair is first heated and is given the desired orientation and shape by means of the hair guides 12, 13, 14 in the heated condition, a better hair-styling performance is achieved.

For influencing the direction in which the air stream 7, 7' flows through the passages 15 the attachment 8 has air guiding surfaces 17 which are pivoted when the carriers 10, 11 are pivoted.

The area of the passages does not decrease when the discharge direction is changed, as a result of which the air flow is not reduced or only to a very small extent when the discharge direction is changed. In its turn, this has the advantage that when the discharge direction is changed, and the heating elements 3 deliver a constant power, the temperature of the outflowing air decreases or hardly increases, even if the air stream would be deflected along with the hair guides. It is of particular importance that this precludes a sudden excessive heating of the scalp and the hair.

In the proposed hair-styling instrument the effective area of the passages 15 increases when the direction of the outflowing air 7' is changed. This has the advantage that the increase in air resistance caused by the fact that the air stream is deflected is compensated by the increase in the overall effective passage area. Thus, variations in air output owing to the deflection of the air stream can remain limited.

In order to obtain a simple construction of the attachment 8 the air guiding surfaces 17 have been arranged on the carriers 10, 11.

In the proposed attachment 8 deflection of the outflowing air in a direction opposite to that in which the hair guides 12, 13, 14 are pivoted is effected in that the air guiding surfaces 17 are each arranged between passages at opposite sides thereof and are each pivotable from a position oriented substantially transversely to the discharge direction to a position oriented more parallel to the discharge direction. In the position oriented transversely to the discharge direction the air guiding surfaces 17 divide the inflowing air substantially uniformly into air streams which flow past these air guiding surfaces 17 and the relevant carriers 10, 11 (see FIG. 3). When the hair guides 12, 13, 14 and hence the carriers 10, 11 are pivoted the air guiding surfaces 17 are tilted from a position oriented substantially transversely to the air stream 7 to a position oriented obliquely relative the air stream 7', as a result of which the air stream is deflected mainly in one direction.

The air guiding surfaces 17 are convexly curved at least in the plane in which they are pivotable, i.e. about the respective pivotal axes. This has the advantage that the air guiding surfaces 17 present a comparatively low air resistance. Moreover, the air resistance presented by the air guiding surfaces 17 is comparatively constant.

Furthermore, as the carriers 10, 11 have a biconvex cross-sectional shape the surfaces of the carriers 10, 11 at the sides of the hair guides 12, 13, 14 also contribute to the deflection of the air stream 7' in the tilted position.

Although the number of carriers can be limited to one, the use of two or more carriers 10, 11 has the advantage that the carriers can be pivoted to a considerable extent and, as a consequence, the direction in which the air stream 7, 7' issues can be influenced considerably without the main outline of the attachment 8 being changed significantly. A limited change of the main outline promotes the ease of handling of the instrument.

The carriers 10, 11 are coupled to one another by coupling means 18, which couple the carriers 10, 11 so as to cause these carriers 10, 11 to be pivoted jointly. As soon as one of the carriers 10, 11 is pivoted under the influence of the force exerted by the hair on the hair guides 12, 13 or 14 which project from this carrier 10, 11, the other one of the carriers 10, 11 is thus moved along, as a result of which an effective change of the direction in which the air stream issues is obtained. Moreover, it is thus prevented that the air resistance caused by the carriers 10, 11 is increased in that they deflect the air stream 7, 7'in opposite directions.

In order to ensure that the carriers 10, 11 are each time pivoted back to the neutral position a resilient element 19 is arranged between the coupling 18 for the carriers 10, 11 and the housing 9, which resilient element urges the carriers 10, 11 into a neutral position. As a result, the air issues frontally from the attachment 8 once the attachment 8 has been taken out of the hair.

The hair guides 12, 13, 14 which project from the carriers 10, 11 are arranged in double rows of V-shaped cross-section, which are oriented parallel to the pivotal axis of the carriers 10, 11. As a result of this arrangement it is achieved that, even if the carriers 10, 11 have been pivoted fully to one side, as is shown in FIG. 4, a number of the hair guides project substantially perpendicularly from the main outline of the attachment 8 and effectively act upon the hair to be styled.

As the attachment comprises coarse hair guides 12, which form a comb, and fine hair guides 13, 14, which form brushes, the attachment can also be used for styling and drying very wet hair, into which the brushes cannot readily penetrate. The effect of the brushes increase gradually as the hair dries. It is then advantageous that the coarse hair guides 12 project farther from the main outline of the attachment than the finer hair guides 13, 14, so that the coarse hair guides 12 of the comb can also be introduced properly into hair when the fine hair guides 13, 14 of the brushes cannot yet properly penetrate into the hair.

At its side which is remote from the hair guides 12, 13, 14 the housing 8 has a coupling portion 20 for coupling to a hair dryer unit, as a result of which the shaving attachment can be exchanged simply. Such a hair dryer unit 1 preferably has a heating element having a power of at least 800 W, so that rapid drying is achieved but sufficient time is left for styling and, when the hair is nearly dry, excessive heating of the head and the hair is prevented.

Figure 5:
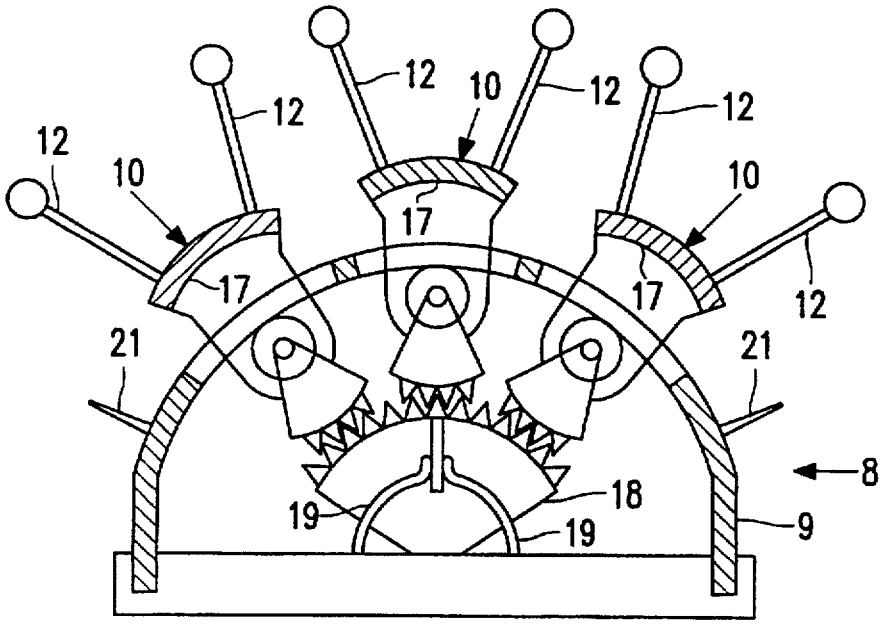
FIG. 5 is a sectional view of an alternative embodiment of the instrument in accordance with the invention.

In the example shown in FIG. 5 the hair guides are all identical, the air guiding surfaces have concave instead of convex shapes, and the coupling between the carriers is constructed as a pivotable element having a toothed segment which meshes with toothed segments of the carriers 10. The resilient element for urging the carriers into the neutral position is also arranged between the housing 9 and the coupling 18 but is constructed as a pair of cooperating blade springs 19 instead of as a helical spring. In order to obtain extra grip on the hair to be styled, the housing has been provided with fixed hair guides 21 at opposite sides of the rows of pivotable hair guides 12.

Some of the many variants within the scope of the invention which have come within the expert's reach will be mentioned hereinafter. In the examples shown herein the instrument has been constructed as an attachment adapted to be mounted on a hair dryer unit. However, the instrument can also be constructed in such a manner that the housing also accommodates an air inlet, a fan and a heating element for heating air which passes through and is consequently integral with and, at least in normal use, not detachable from the hair dryer unit.

Moreover, it is possible to orient the outflowing air stream in a direction opposite to the pivoting direction of the hair guides by selectively closing the air outlet passages in response to the pivotal movement of the carrier and the enveloping surfaces which project from this carrier.

We claim:

1. An instrument for styling hair, comprising a housing, at least one carrier which is pivotably supported by the housing, elongate hair guides which project from the carrier and which are movable along with the carrier, and at least one passage for allowing hot air to pass through in a discharge direction away from the housing, the passage and the carrier being adapted to influence the discharge direction in dependence upon the position of the carrier with respect to the housing, and further comprising at least one air guiding surface, wherein the carrier is adapted to influence the passage in such a manner that a movement of the hair guides which project from the carrier in a first direction with respect to the housing results in a change of the discharge direction through said passage in a second direction substantially opposite to said first direction, and wherein the air guiding surface is pivotable between a position oriented substantially transversely to the discharge direction and a position oriented more parallel to the discharge direction.

2. An instrument as claimed in claim 1, wherein said at least one air guiding surface, which is movable along with the carrier for changing the direction of the air passing through the passage, and the carrier are constructed in such a manner that the effective discharge area of the passage in a position of the carrier for deflecting the outflowing air is at least equal to the effective discharge area of the passage in a position of the carrier for the substantially straight passage of the outflowing air.

3. An instrument as claimed in claim 1, in which the air guiding surface and the carrier are constructed in such a manner that the effective discharge area of the passage in a position of the carrier for deflecting the outflowing air is greater than the effective discharge area of the passage in a position of the carrier for the substantially straight passage of the outflowing air.

4. An instrument as claimed in claim 3, in which the air guiding surface is carried by the carrier.

5. An instrument as claimed in claim 3, in which the air guiding surface is disposed between passages at opposite sides of said air guiding surface.

6. An instrument as claimed in claim 1, in which the air guiding surface is curved at least in the plane in which said air guiding surface is pivotable.

7. An instrument as claimed in claim 6, in which the carrier has a biconvex shape in a cross-section perpendicular to the carrier's pivotal axis.

8. An instrument as claimed in claim 1, comprising at least two of said carriers.

9. An instrument as claimed in claim 8, further comprising coupling means which couple the carriers to one another so as to cause the carriers to be pivoted jointly.

10. An instrument as claimed in claim 1, in which the carrier is supported so as to be pivotable about a pivotal axis with respect to the housing and the hair guides which project from the carrier are arranged in double rows of V-shaped cross-section, which are oriented parallel to said pivotal axis.

11. An instrument as claimed in claim 10, in which the hair guides include coarse hair guides which form a comb and fine hair guides which form a brush.

12. An instrument as claimed in claim 1, in which the housing has a coupling portion which is remote from the hair guides, for coupling to a hair dryer unit.

13. An instrument as claimed in claim 1, further comprising a hair dryer unit having an air inlet, a fan and a heating element for heating air which passes through.

14. An instrument as claimed in claim 1, which also comprises an air inlet, a fan and a heating element for heating air which passes through.

* * * * *